US008286573B2

(12) United States Patent
Hoge, Jr.

(10) Patent No.: US 8,286,573 B2
(45) Date of Patent: Oct. 16, 2012

(54) EXTERNAL INFLATABLE KEEL FOR PORTABLE INFLATABLE BOATS

(75) Inventor: Cecil C. Hoge, Jr., Setauket, NY (US)

(73) Assignee: Sea Eagle Boats, Inc., Port Jefferson, NY (US)

( * ) Notice: Subject to any disclaimer, the term of this patent is extended or adjusted under 35 U.S.C. 154(b) by 245 days.

(21) Appl. No.: 12/801,515

(22) Filed: Jun. 11, 2010

(65) Prior Publication Data

US 2011/0303139 A1 Dec. 15, 2011

(51) Int. Cl.

| | |
|---|---|
| ***B63B 7/00*** | (2006.01) |
| ***B63B 35/00*** | (2006.01) |
| ***B63B 3/38*** | (2006.01) |
| ***B63H 11/107*** | (2006.01) |

(52) U.S. Cl. ..... 114/345; 441/40; 114/347; 114/140

(58) Field of Classification Search ..... 114/39.26, 114/345, 347, 61.25, 138, 140, 143, 122, 114/126, 127; 441/40, 41

See application file for complete search history.

(56) References Cited

U.S. PATENT DOCUMENTS

| | | | | |
|---|---|---|---|---|
| 2,370,069 | A * | 2/1945 | Patten | 114/345 |
| 2,698,020 | A | 12/1954 | Phane | |
| 3,056,980 | A | 10/1962 | Holladay | |
| 3,935,607 | A | 2/1976 | Cantwell et al. | |
| 4,251,893 | A * | 2/1981 | McCrory et al. | 114/345 |
| 4,462,331 | A * | 7/1984 | McCrory | 114/345 |
| 4,545,319 | A | 10/1985 | Ferronniere et al. | |
| 4,603,651 | A | 8/1986 | Harding | |
| 4,640,217 | A * | 2/1987 | Ferronniere | 114/345 |
| 4,722,292 | A | 2/1988 | Marino et al. | |
| 5,642,685 | A | 7/1997 | Garnier | |
| 5,868,095 | A | 2/1999 | Zeromski et al. | |
| 5,964,176 | A | 10/1999 | Grunau et al. | |
| 6,003,465 | A | 12/1999 | Khachatrian et al. | |
| 6,209,476 | B1 | 4/2001 | Maurel et al. | |
| 7,159,529 | B2 | 1/2007 | Durand et al. | |
| 7,185,600 | B2 * | 3/2007 | Toussi et al. | 114/345 |
| 8,082,871 | B2 * | 12/2011 | Czarnowski et al. | 114/345 |
| 2006/0096517 | A1 | 5/2006 | Durand et al. | |
| 2006/0144313 | A1 | 7/2006 | Toussi et al. | |
| 2009/0049757 | A1 * | 2/2009 | Potter | 52/2.23 |

FOREIGN PATENT DOCUMENTS

| | | | |
|---|---|---|---|
| CN | 201189943 | Y | 2/2009 |
| GB | 2152441 | A * | 8/1985 |
| GB | 2 351 261 | | 7/2002 |
| GB | 2 414 970 | | 1/2008 |

* cited by examiner

*Primary Examiner* — Lars A Olson
*Assistant Examiner* — Andrew Polay
(74) *Attorney, Agent, or Firm* — Staas & Halsey LLP

(57) ABSTRACT

An inflatable boat including at least one inflatable tube forming first and second pontoons, the first and second pontoons meeting at a front of the boat to form a stem; a floor constructed of a flexible non-inflated fabric material spanning the area between the first and second pontoons and attached to the bottom of the first and second pontoons; and an inflatable keel formed of an inflatable high-pressure drop stitch material and secured to the bottom of the floor.

17 Claims, 7 Drawing Sheets

EXTERNAL INFLATABLE KEEL FOR PORTABLE INFLATABLE BOATS

BACKGROUND

1. Field

Embodiments relate to watercraft, and more particularly, to an external inflatable keel for inflatable boats.

2. Description of the Related Art

Small watercraft are used for a number of activities such as fishing, rowing, sailing, rafting, paddling, motoring and recreational boating. Larger and some small watercraft are commonly equipped with a keel, or an underwater extension protruding from the bottom of the watercraft. The keel functions to provide stability and resist sideways movement or drift.

Inflatable watercraft also may be found without a keel or with an inflatable internal keel positioned between an exterior fabric floor and a rigid or semi-rigid interior floor such as a drop stitch floor or wooden, plastic or aluminum sectional floorboards.

Watercraft not having a keel tend to slide when turning and do not plane properly at high speeds. In particular, watercraft not having a keel tend to plow with their bow up instead of getting on a plane at twice the speed. Watercraft, such as the inflatable pontoon boat 100 shown in FIG. 1 having an internal keel 110 demonstrate better performance in turns and will plane at high speeds. However, an inflatable pontoon boat 100 with a conventional internal keel 110 have a greater tendency to tip because the floor 120 tends to bend where the internal keel 110 is located. Also, pontoon boats with internal keels 110 tend to slide over water because of their soft rounded shape.

In an inflatable kayak without a keel, the kayak will tend to yaw, or move sideways, from the intended course with each stroke of the double-ended paddle. This yaw reduces the efficiency of the kayak, resulting in lower speeds and increasing the fatigue of the paddler.

Due to these problems and others an inflatable watercraft with an improved keel design is desired.

SUMMARY

Therefore, it is one aspect of the present invention to provide an external inflatable keel for inflatable boats.

Additional aspects will be set forth in part in the description which follows and, in part, will be apparent from the description, or may be learned by practice of the invention.

According to an aspect, an inflatable boat includes at least one inflatable tube forming first and second pontoons, the first and second pontoons meeting at a front of the boat to form a stem; a floor constructed of a flexible non-inflated fabric material spanning the area between the first and second pontoons and attached to the bottom of the first and second pontoons; and an inflatable keel formed of an inflatable high-pressure drop stitch material and secured to the bottom of the floor.

The inflatable boat may further include a floor made of inflatable high-pressure drop stitch material placed on top of the flexible non-inflated fabric floor.

The inflatable boat may further include rigid floorboards made of wood, plastic or aluminum placed on top of the flexible non-inflated fabric floor.

In the inflatable boat, the non-inflated fabric floor may be attached to the at least one inflatable tube by gluing.

In the inflatable boat, the non-inflated fabric floor may be attached to the at least one inflatable tube by welding.

In the inflatable boat, the at least one inflatable tube may be constructed of polyester fabric and may further include at least one air valve.

In the inflatable boat, the floor and the inflatable keel may be each made of polyester fabric and the floor may further include an air valve to inflate the inflatable keel.

In the inflatable boat, the ratio of the length of the inflatable keel to the width of the inflatable keel may be at least 5:1.

In the inflatable boat, the inflatable boat may not include a skeg.

In accordance with another aspect, an inflatable kayak includes at least two inflatable tubes forming first and second pontoons, the first and second pontoons meeting at a front of the kayak to form a stem, and the first and second pontoons meeting at a rear of the kayak to form a stern; a floor constructed of a flexible non-inflated fabric material spanning the area between the first and second pontoons and attached to the bottom of the first and second pontoons; and an inflatable keel formed of an inflatable high-pressure drop stitch material and secured to the bottom of the floor by gluing or welding.

The inflatable kayak may further include a skeg attached to the bottom of the aft end of the non-inflated flexible fabric floor.

In the inflatable kayak, the non-inflated flexible fabric floor may be attached to the first and second pontoons by gluing or welding.

In the inflatable kayak, the at least two inflatable tubes may be constructed of polyester fabric and each may further include an air valve.

In the inflatable kayak, the ratio of the length of the inflatable keel to the width of the inflatable keel may be at least 5:1.

In accordance with another aspect, an inflatable sailboat includes at least two inflatable tubes forming first and second pontoons, the first and second pontoons being substantially parallel; a frame constructed of rigid material connecting the first and second pontoons; two inflatable keels formed of an inflatable high-pressure drop stitch material and secured to the bottom of each of the first and second pontoons.

The inflatable sailboat may further include one skeg attached to the bottom of the aft end of each of the first and second pontoons.

In the inflatable sailboat, the at least two inflatable tubes may be constructed of polyester fabric and each may further include an air valve.

In the inflatable sailboat, the ratio of the length of each inflatable keel to the width of each inflatable keel may be at least 5:1.

The inflatable sailboat of may further include a transom made of plastic or wood, the transom being configured to support a rudder and/or a motor.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE EMBODIMENTS

Figure 1:
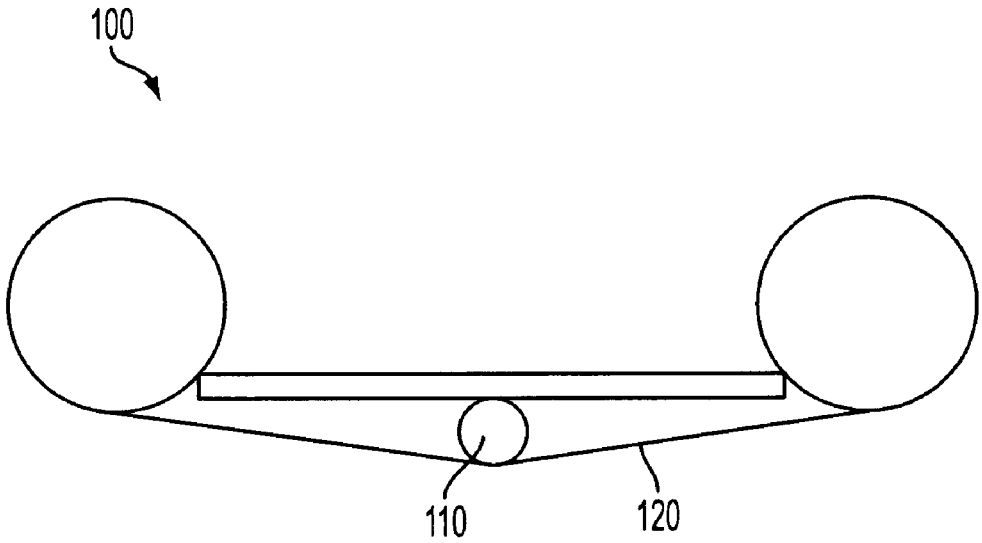
FIG. 1 PRIOR ART
FIG. 1 is front sectional view of a conventional inflatable pontoon boat.

Reference will now be made in detail to the embodiments of the present invention, examples of which are illustrated in the accompanying drawings, wherein like reference numerals refer to like elements throughout. The embodiments are described below to explain the present invention by referring to the annexed drawings.

Figure 2:
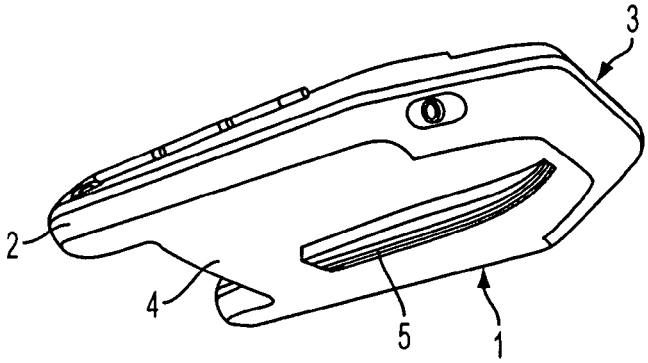
FIG. 2 is a bottom perspective view of an inflatable boat in accordance with an embodiment.
Figure 3:
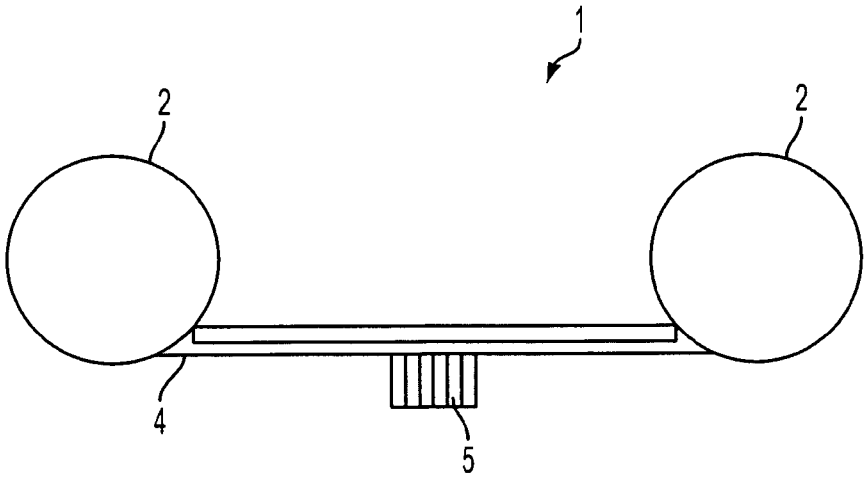
FIG. 3 is front sectional view of an inflatable boat in accordance with an embodiment.
Figure 4:
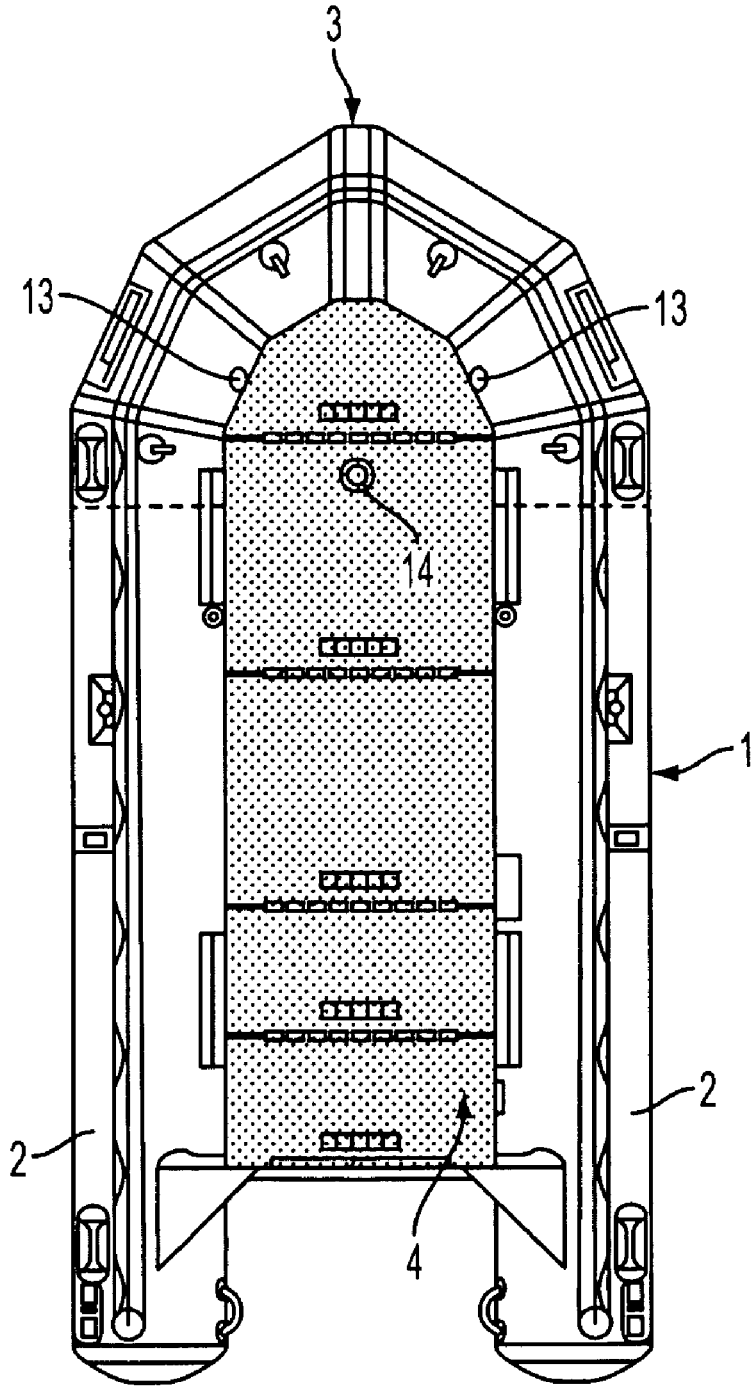
FIG. 4 is a top view of an inflatable boat in accordance with an embodiment.

FIGS. 2-4 show an inflatable boat in accordance with an embodiment of the present invention. Herein, the term high pressure drop stitch material construction refers to upper and lower fabric layers and also a core section made up of an array of threads extending throughout the drop stitch structure. A benefit of this material is that the inflated the walls of the material create rectangular shapes of varying lengths, widths and depths, instead of taking on a rounded "balloon" shape. As shown in FIG. 2, the inflatable boat, generally designated by the reference numeral 1, includes at least one inflatable tube forming pontoons 2 which meet at the front of the boat to form a stem 3. The inflatable boat further includes a floor 4 made of a flexible non-inflated fabric material, which spans the area between the two pontoons 2 of the inflatable tube and is attached to the bottom of the inflatable tube. An inflatable high-pressure drop stitch keel 5 is attached to the bottom of the floor 4 by means of a gluing or welding. When the high-pressure drop stitch keel 5 is inflated, a rectangular external keel is formed. Because of the drop stitch construction of the inflatable keel 5, the inflated keel 5 maintains a generally rectangular shape in cross-section instead of a rounded shape. This generally rectangular shape improves the performance and efficiency of the keel 5.

The floor 4 is generally attached to the bottom of the inflatable tube 2 by means of gluing or welding but other means for attaching the floor 4 to the bottom of the inflatable pontoons 2 may be used.

The inflatable pontoons 2 are generally made of 1000 denier polyester fabric but may be made of other stronger or weaker fabric materials. As depicted in FIG. 4, the inflatable pontoons 2 further include air valves 13, preferably one-way air valves to prevent blow back during inflation and fast deflation.

The non-inflatable flexible fabric floor 4 is generally made of 1000 denier polyester fabric but may be made of other stronger or weaker fabric materials. As depicted in FIG. 4, the floor 4 further includes an air valve 14, preferably a one-way air valve to prevent blow back during inflation and fast deflation, to allow inflation of the inflatable keel.

In order to allow the inflatable keel 5 to cut through the water and provide additional stability, the inflated keel will be of generally long and narrow dimensions. The ratio of the length of the inflated keel to the width of the inflated keel is generally 6:1, but the exact ratio may be greater or smaller. The inflated keel further provides additional buoyancy.

In the inflatable boat 1, above the non-inflated flexible fabric floor is either an additional inflatable floor of high-pressure drop stitch construction, or floorboards made of wood, plastic, or aluminum laid transversely across the non-inflated flexible fabric floor 4 to provide a more rigid floor surface.

It is another feature of the present invention that the structure of the external inflatable keel 5 provides that the inflatable boat 1 does not require a skeg or rudder.

Figure 5:
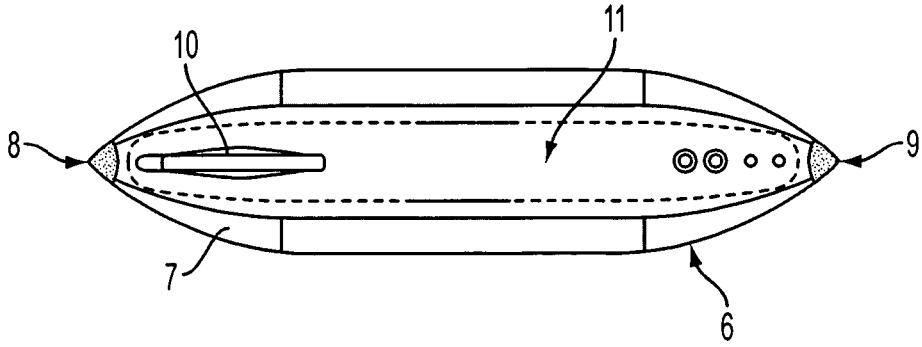
FIG. 5 is a bottom view of an inflatable kayak in accordance with an embodiment.
Figure 6:
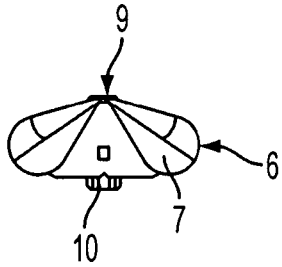
FIG. 6 is a rear view of an inflatable kayak in accordance with an embodiment.
Figure 7:
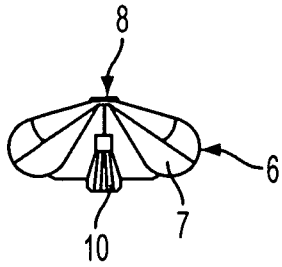
FIG. 7 is a front view of an inflatable kayak in accordance with an embodiment.

In another embodiment of the present invention, FIGS. 5-9 show an inflatable kayak. As shown in FIG. 5 the inflatable kayak, generally designated by the reference numeral 6, includes at least two inflatable pontoons 7 which meet at the front of the kayak 6 to form a stem 8. The pontoons 7 meet at the rear of the boat to form a stern 9. The kayak 6 further includes a floor 11 made of a flexible non-inflated fabric material, which spans the area between the pontoons 7 and is attached to the bottom of the inflatable tube 7. An inflatable high-pressure drop stitch keel 10 is attached to the bottom of the floor 11 by means of gluing or welding. When the high-pressure drop stitch keel 10 is inflated, an external inflatable keel 10 is formed. Because of the drop stitch construction of the inflatable keel 10, the inflated keel 10 maintains a generally rectangular cross-section instead of a rounded shape. This generally rectangular shape improves the performance and efficiency of the keel 10. It also improves the floating stability of the boat because it acts as an outside keel on a sailboat.

Figure 8:
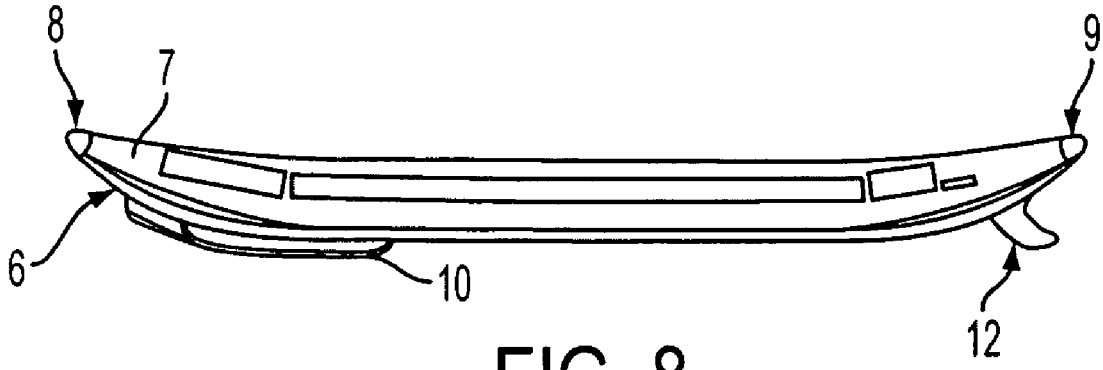
FIG. 8 is a side view of an inflatable kayak in accordance with an embodiment.

As depicted in FIG. 8, the kayak 6 may further include a skeg 12 attached to the bottom side of the flexible non-inflated fabric floor 11 under the stern 9. The skeg 12 in combination with the inflatable keel formed by the keel 10 prevents the kayak 6 from slide slipping and wandering, and further provides for more accurate maneuvering. This combination of inflatable bow keel 10 and skeg 12 provide additional floating stability like the keel or rudder of a sailboat.

The flexible non-inflated fabric floor 11 is attached to the bottom of the pontoons 7 by means of a gluing or welding but other means for attaching the floor 11 to the bottom of the inflatable tube 7 may be used.

Figure 9:
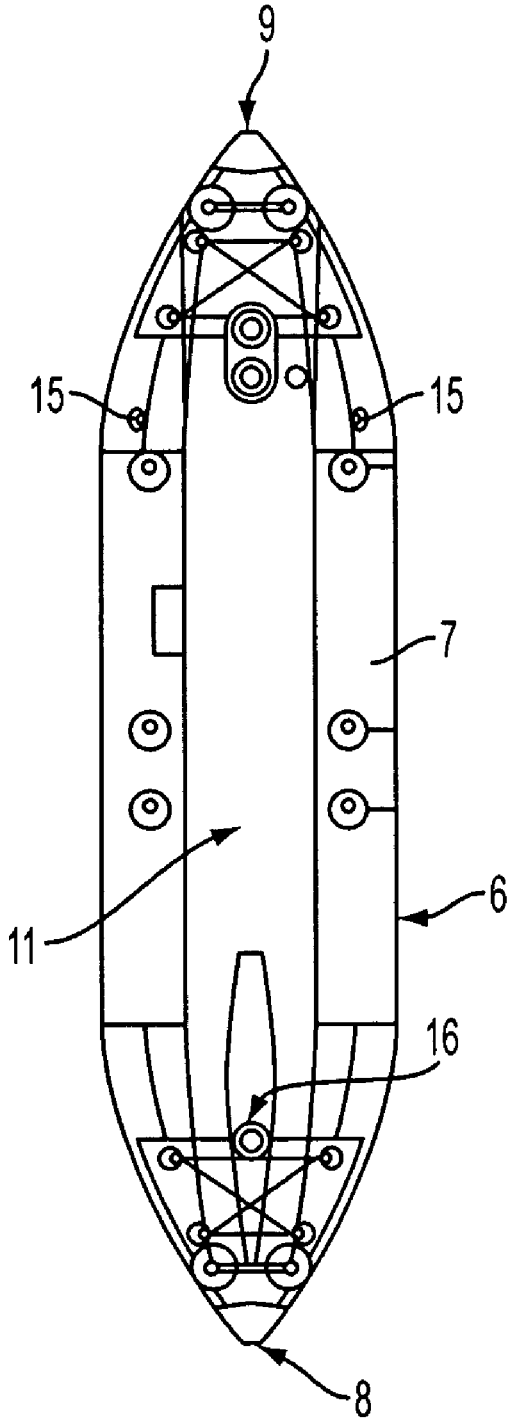
FIG. 9 is a top view of an inflatable kayak in accordance with an embodiment.

The pontoons 7 are generally made of 1000 denier polyester fabric but may be made of other stronger or weaker fabric materials. As depicted in FIG. 9, the pontoons 7 further include an air valve 15, preferably a one-way air valve to prevent blow back during inflation and fast deflation.

The floor 11 and inflatable keel 10 are each generally made of 1000 denier polyester fabric but may be made of other stronger or weaker fabric materials. As depicted in FIG. 9, the floor 11 further includes an air valve 16, preferably a one-way air valve to prevent blow back during inflation and fast deflation, to allow inflation of the inflatable keel 10.

In order to allow the inflatable keel to cut through the water and provide additional stability the inflated keel will be of generally long and narrow dimensions. The ratio of the length of the inflated keel to the width of the inflated keel is generally 6:1, but the exact ratio may be greater or smaller.

Figure 10:
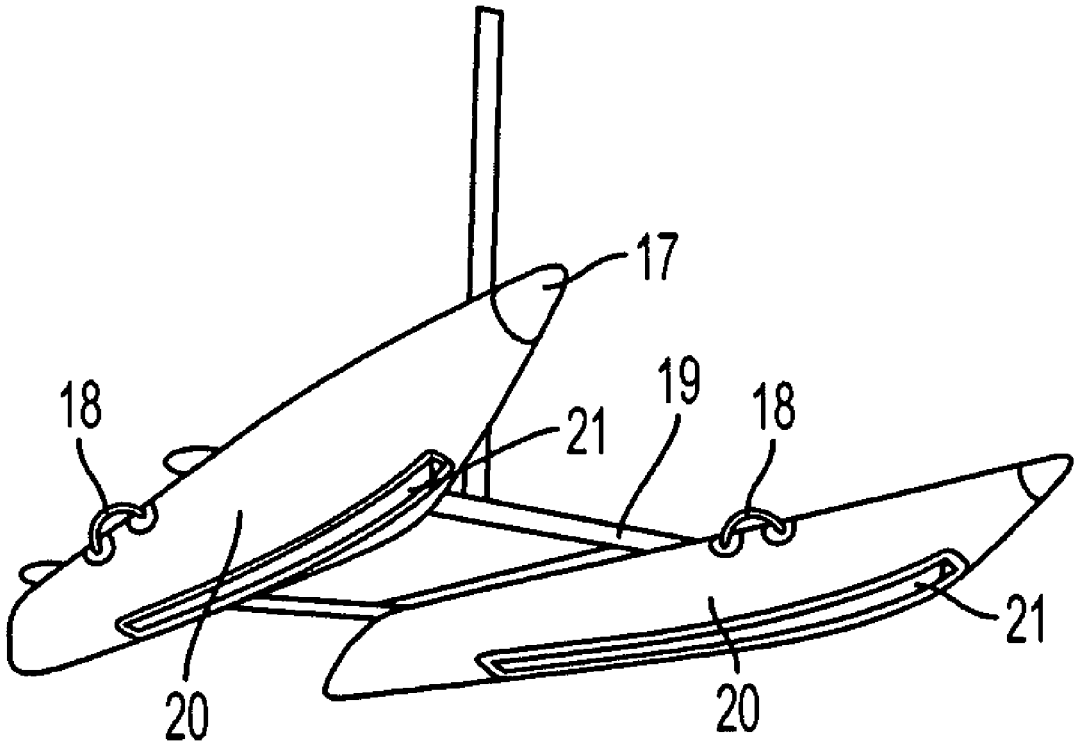
FIG. 10 is a bottom perspective view of an inflatable sailboat in accordance with an embodiment

In another embodiment of the present invention, FIG. 10 shows an inflatable sailboat. As shown in FIG. 10, the inflatable sailboat, generally designated by reference numeral 17, includes at least two inflatable pontoons 18. The inflatable sailboat 17 further includes a frame 19 made of a rigid material, which connects the two pontoons 18. Inflatable keels 21 made of inflatable high-pressure drop stitch fabric are attached to the bottom of each of the pontoons 18 by means of gluing or welding. When the high-pressure drop stitch fabric is inflated, external inflatable keels 21 are formed. Because of the drop stitch construction of the inflatable keels 21, the inflated keels 21 maintain a generally rectangular cross-section instead of a rounded cross section. This generally rectangular shape improves the performance and efficiency of the keels 21 and floating stability.

The inflatable pontoons 18 are generally made of 1000 denier polyester fabric but may be made of other stronger or weaker fabric materials.

In order to allow the inflatable keels 21 to cut through the water and provide additional stability the inflated keels 21 will be of generally long and narrow dimensions. The ratio of the length of the inflated keel to the width of the inflated keel is generally between 5:1 to 25:1, but the exact ratio may be greater or smaller.

Although several embodiments of the invention have been shown and described, it would be appreciated by those skilled in the art that changes may be made in these embodiments without departing from the principles and spirit of the invention, the scope of which is defined in the claims and their equivalents.

What is claimed is:

1. An inflatable boat, comprising:

at least one inflatable tube forming first and second pontoons, the first and second pontoons meeting at a front of the boat to form a stem;

a floor constructed of a flexible non-inflated fabric material spanning the area between the first and second pontoons and attached to the bottom of the first and second pontoons;

a floor made of inflatable drop stitch material placed on top of the flexible non-inflated fabric floor; and an inflatable keel formed of an inflatable drop stitch material and secured directly to an outer bottom surface of the flexible non-inflated fabric material floor, the inflatable keel being completely positioned on a bow portion of the inflatable boat.

2. The inflatable boat of claim 1, further comprising:

rigid floorboards made of wood, plastic or aluminum.

3. The inflatable boat of claim 1, wherein the non-inflated fabric floor is attached to the at least one inflatable tube by gluing.

4. The inflatable boat of claim 1, wherein the non-inflated fabric floor is attached to the at least one inflatable tube by welding.

5. The inflatable boat of claim 1, wherein the at least one inflatable tube is constructed of polyester fabric and further includes at least one air valve.

6. The inflatable boat of claim 1, wherein the floor and the inflatable keel are each made of polyester fabric and the floor further includes an air valve to inflate the inflatable keel.

7. The inflatable boat of claim 1, wherein the ratio of the length of the inflatable keel to the width of the inflatable keel is at least 5:1.

8. The inflatable boat of claim 1, wherein the inflatable boat does not include a skeg.

9. An inflatable kayak, comprising:

at least two inflatable tubes forming first and second pontoons, the first and second pontoons meeting at a front of the kayak to form a stem, and the first and second pontoons meeting at a rear of the kayak to form a stern;

a floor constructed of a flexible non-inflated fabric material spanning the area between the first and second pontoons and attached to the bottom of the first and second pontoons; and an inflatable keel formed of an inflatable drop stitch material and secured to an outer bottom surface of the flexible non-inflated fabric material floor by gluing or welding, the inflatable keel being completely positioned on a bow portion of the inflatable kayak.

10. The inflatable kayak of claim 9, further comprising:

a skeg attached to the bottom of the aft end of the non-inflated flexible fabric floor.

11. The inflatable kayak of claim 9, wherein the non-inflated flexible fabric floor is attached to the first and second pontoons by gluing or welding.

12. The inflatable kayak of claim 9, wherein the at least two inflatable tubes are constructed of polyester fabric and each further includes an air valve.

13. The inflatable kayak of claim 9, wherein the ratio of the length of the inflatable keel to the width of the inflatable keel is at least 6:1.

14. An inflatable sailboat, comprising:

at least two inflatable tubes forming first and second pontoons, the first and second pontoons being substantially parallel;

a frame constructed of rigid material connecting the first and second pontoons;

two inflatable keels formed of an inflatable drop stitch material and secured to an outer bottom surface of each of the first and second pontoons whereby the two inflatable keels maintain a rectangular shape when inflated.

15. The inflatable sailboat of claim 14, further comprising:

one skeg attached to the bottom of the aft end of each of the first and second pontoons.

16. The inflatable sailboat of claim 14, wherein the at least two inflatable tubes are constructed of polyester fabric and each further includes an air valve.

17. The inflatable sailboat of claim 14, wherein the ratio of the length of each inflatable keel to the width of each inflatable keel is at least 5:1.

* * * * *

UNITED STATES PATENT AND TRADEMARK OFFICE

CERTIFICATE OF CORRECTION

PATENT NO. : 8,286,573 B2
APPLICATION NO. : 12/801515
DATED : October 16, 2012
INVENTOR(S) : Cecil C. Hoge, Jr.

It is certified that error appears in the above-identified patent and that said Letters Patent is hereby corrected as shown below:

In the Claims, Col. 6, lines 3-16

Please delete claim 9 in its entirety and replace with the following

-- 9. An inflatable kayak, comprising:

at least two inflatable tubes forming first and second pontoons, the first and second pontoons meeting at a front of the kayak to form a stem, and the first and second pontoons meeting at a rear of the kayak to form a stern;

a floor constructed of a flexible non-inflated fabric material spanning the area between the first and second pontoons and attached to the bottom of the first and second pontoons; and an inflatable keel formed of an inflatable drop stitch material and secured directly to an outer bottom surface of the flexible non-inflated fabric material floor by gluing or welding, the inflatable keel being completely positioned on a bow portion of the inflatable kayak and maintaining a rectangular shape when viewed in a longitudinal direction when inflated. --

Signed and Sealed this
Eighteenth Day of February, 2014

Michelle K. Lee

Michelle K. Lee
*Deputy Director of the United States Patent and Trademark Office*